US008448489B2

(12) United States Patent
Popovitch

(10) Patent No.: US 8,448,489 B2
(45) Date of Patent: May 28, 2013

(54) POWER CRIMPING DEVICE AND METHOD FOR CRIMPING BUILDING PANELS

(75) Inventor: Lou S. Popovitch, Johnstown, PA (US)

(73) Assignee: M.I.C. Industries, Inc., Reston, VA (US)

( * ) Notice: Subject to any disclaimer, the term of this patent is extended or adjusted under 35 U.S.C. 154(b) by 1113 days.

(21) Appl. No.: 12/285,058

(22) Filed: Sep. 29, 2008

(65) Prior Publication Data

US 2010/0077827 A1 Apr. 1, 2010

(51) Int. Cl.
*B21D 37/00* (2006.01)

(52) U.S. Cl.
USPC ..... 72/408; 72/482.8

(58) Field of Classification Search
USPC ..... 72/48, 121, 122, 408, 409.09, 481.1, 72/482.8; 29/243.5, 243.57, 243.58
See application file for complete search history.

(56) References Cited

U.S. PATENT DOCUMENTS

| | | | | |
|---|---|---|---|---|
| 3,609,845 | A | 10/1971 | Taylor | |
| 3,797,430 | A * | 3/1974 | Boudreau | 29/243.57 |
| 3,902,233 | A | 9/1975 | Ohtsu | |
| 3,987,740 | A * | 10/1976 | Merson | 29/243.58 |
| 4,072,118 | A | 2/1978 | Schultheiss | |
| 4,279,211 | A * | 7/1981 | Stellrecht | 29/402.19 |
| 4,364,253 | A | 12/1982 | Knudson | |
| 5,243,748 | A | 9/1993 | Morello | |
| 5,623,805 | A | 4/1997 | Morello | |
| 6,115,898 | A * | 9/2000 | Sawdon | 29/243.5 |
| 6,115,899 | A | 9/2000 | Rider | |

OTHER PUBLICATIONS

International Search Report dated Nov. 4, 2009, from corresponding International Application No. PCT/US2009/05378.
Written Opinion of the International Searching Authority dated Nov. 4, 2009 from corresponding International Application No. PCT/US2009/05378.

* cited by examiner

*Primary Examiner* — Teresa M Ekiert
(74) *Attorney, Agent, or Firm* — Jones Day

(57) ABSTRACT

An device for crimping together adjacent edge portions of two building panels including a frame supporting a rotatable shaft protruding therethrough, a first crimping member attached to the frame, a gear train supported by the frame coupled to the rotatable shaft such that a rotation of the rotatable shaft imparts rotary motion to the gear train, a drive mechanism supported by the frame and rotatably coupled to the gear train, and a second crimping member supported by the frame and coupled to the drive mechanism, wherein the second crimping member is configured to move toward and then away from the first crimping member in a repeating, reciprocating motion under influence of the drive mechanism while rotation of the rotatable shaft is maintained, such that the second crimping member is configured to bend an edge portion of a first building panel over an edge portion of a second building panel.

20 Claims, 15 Drawing Sheets

POWER CRIMPING DEVICE AND METHOD FOR CRIMPING BUILDING PANELS

BACKGROUND

1. Field of the Disclosure

The present disclosure relates to a crimping device and method for crimping together edge portions of adjacent building panels.

2. Background Information

Construction techniques are known for constructing buildings using adjacent metal building panels that are attached together at their adjacent edges. Such building panels may include a main portion from which side edge portions extend. The side edge portions may be configured so that the edge of one panel can be disposed inside the edge of another panel and then crimped together. Once the panels have been crimped together, a rotary seam forming device can be applied to the panels to form a more watertight seam. Devices for crimping the building panels together are known in the art and are commercially available from M. I. C. Industries, Inc. of Reston, Va. Exemplary devices are shown, for example, in U.S. Pat. No. 5,243,748, which is owned by M. I. C. Industries, Inc.

The present inventors have observed, however, that attempting to crimp building panels within a confined space, such as a concrete foundation form, can be difficult because the distance between the foundation form and the panels may be insufficient for conventional devices to operate. Leaving a portion of the seam of adjacent building panels uncrimped can be undesirable because it may permit unwanted water to accumulate in the seams of adjacent building panels at the building foundation. In addition, conventional crimping devices may require the user to separately activate each crimping action of the device, requiring the user to separately reposition the crimping device for each individual crimping action (e.g., each open/close cycle of a pair of crimping jaws).

The crimping device and methods disclosed herein may address these and other needs.

SUMMARY

The present disclosure is directed to crimping devices and methods. In certain exemplary embodiments there is provided a device for crimping together adjacent edge portions of two building panels. The device includes a frame supporting a rotatable shaft protruding therethrough, a first crimping member attached to the frame, a gear train supported by the frame coupled to the rotatable shaft such that a rotation of the rotatable shaft imparts rotary motion to the gear train, and a drive mechanism supported by the frame and rotatably coupled to the gear train, a second crimping member supported by the frame and coupled to the drive mechanism, wherein the second crimping member is configured to move toward and then away from the first crimping member in a repeating, reciprocating motion under influence of the drive mechanism while rotation of the rotatable shaft is maintained, such that the second crimping member is configured to bend an edge portion of a first building panel over an edge portion of a second building panel.

In certain exemplary embodiments there is provided a device for crimping together adjacent edge portions of two building panels. The device includes a frame supporting a rotatable shaft protruding therethrough, a first crimping member attached to the frame, a reduction means coupled to the rotatable shaft and supported by the frame, for reducing a rotational speed of the shaft while simultaneously increasing torque, a transforming means supported by the frame and rotatably coupled to the gear train, for converting the rotational motion of the rotatable shaft into a rectilinear motion, and a second crimping member supported by the frame and coupled to the reduction means, wherein the second crimping member is configured to move toward and then away from the first crimping member in a repeating, reciprocating motion under influence of the transforming means while rotation of the rotatable shaft is maintained, such that the second crimping member is configured to bend an edge portion of a first building panel over an edge portion of a second building panel.

In certain exemplary embodiments there is provided a method of crimping together adjacent edge portions of two building panels. The method includes the steps of engaging the crimping device having a frame, a first crimping member and an opposing second crimping member onto a seam of two adjacent building panels, activating the crimping device such that the first crimping member and second crimping member repeatedly, and in a reciprocating motion, engage the seam of the two building panels under influence of a drive mechanism, thereby crimping together edge portions of the two building panels, and moving the crimping device lengthwise along the seam of the building panels such that a substantial lengthwise portion of the seam is crimped together.

The exemplary devices and methods disclosed herein may provide certain advantages. One advantage is to reduce operator fatigue and make the crimping process easier by using rotary motion to constantly move the crimping blades in a repeatable open and close motion as long as power is maintained on the motor. Another advantage is to allow a crimping device to easily fit into a confined space. Because of the rotary motion and compact size, the user may easily crimp a panel seam deep into the concrete form thus providing a watertight seal of the panels deep into a concrete form. Another advantage is to provide a crimping device that will not scratch or damage the surface of the building panels on which it is being applied. Yet another advantage is to allow a crimping device to be driven by a commercially available off-the-shelf motor such as a power drill.

BRIEF DESCRIPTION OF THE DRAWINGS

These and other features, aspects, and advantages of embodiments of the present disclosure will become better understood with regard to the following description, appended claims, and accompanying drawings where:

DETAILED DESCRIPTION

Figure 1:
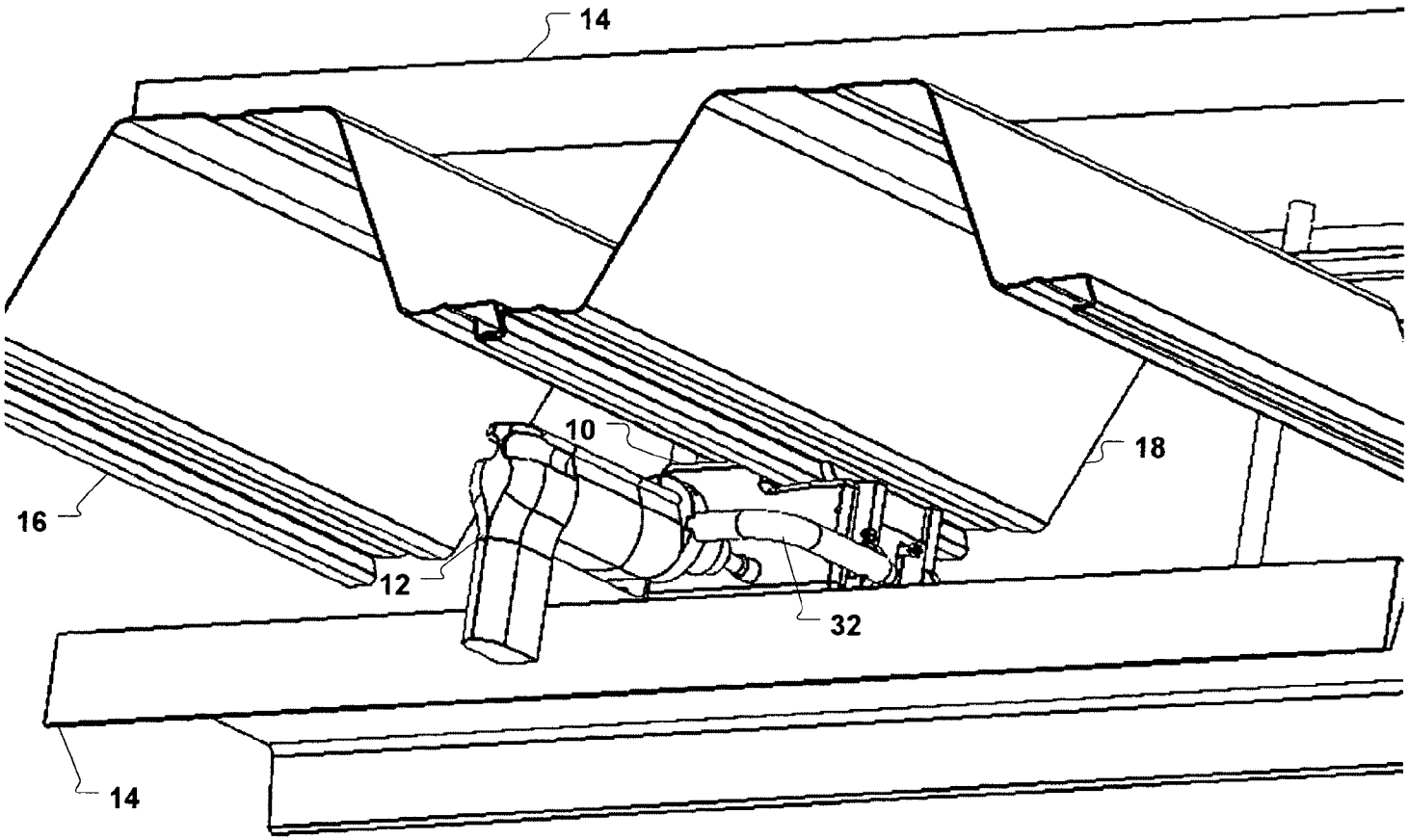
FIG. 1 illustrates an isometric view of an exemplary crimping device disposed over the seams of adjacent building panels that are inserted into a foundation form in accordance with certain embodiments.

Certain features of the exemplary embodiments described herein are described with reference to directions, e.g., up, and down. With reference to FIG. 1, for the purposes of this disclosure, up, upwardly, and the like refers to a direction from the crimping device 10 generally toward the building panels 16, 18. Down, downwardly, and the like refers to the direction from the building panels 16, 18 generally toward the crimping device 10. Thus the top of the crimping device 10 would refer to a side of the crimping device facing the building panels 16, 18 and the bottom of the crimping device 10 would refer to an opposing side of the crimping device 10, for example. Obviously the directions are relative and are described for illustrative purposes only—they should not be construed to limit the scope of the disclosure or the claims.

FIGS. 1-7 illustrate an exemplary crimping device 10 for crimping together edge portions of adjacent building panels in accordance with certain embodiments of the present disclosure. FIG. 1 illustrates the device 10 inserted into the confined space of a concrete foundation form 14 engaged with the edge portions of two adjacent building panels 16, 18. The crimping device 10 can be supported by a hand-held power drill 12 to provide motive force and support members 32 (e.g., tubes or bars), both of which can be coupled to the device 10. The power drill 12 can be released from the crimping device 10 as will be discussed later.

In operation, an operator, grasping a handle of the power drill 12 and possibly support member 32, first inserts the device 10, which has two opposing crimping members, into a narrow space beneath two building panels (i.e., the space between the concrete foundation form 14 and the building panels 16, 18). Upon insertion, the operator engages the crimping members on a seam of the two building panels. The operator then activates the device (e.g., depresses the trigger of the power drill 12) such that the first crimping member and second crimping member repeatedly engage the seam of the two building panels (e.g., repeatedly open and close under the influence of constant rotary power from the power drill 12), thereby crimping together the edge portions of the two building panels. In other words, the crimping members repeatedly reciprocate open and closed as long as the power drill 12 applies rotary force in one direction (e.g., clockwise). Then the operator can move the device 10 lengthwise along the seam of the building panels such that a substantial lengthwise portion (i.e., as much of the seam as the operator wants crimped) of the seam is crimped together. Advantageously, this technique allows the repositioning of the crimping device 10 to be assisted by gravity. While the exemplary embodiments described include a commercial power drill as the motor, any other suitable motor capable of producing rotation could be used. For example, a specially designed motor could be manufactured and sold with the device.

Figure 2:
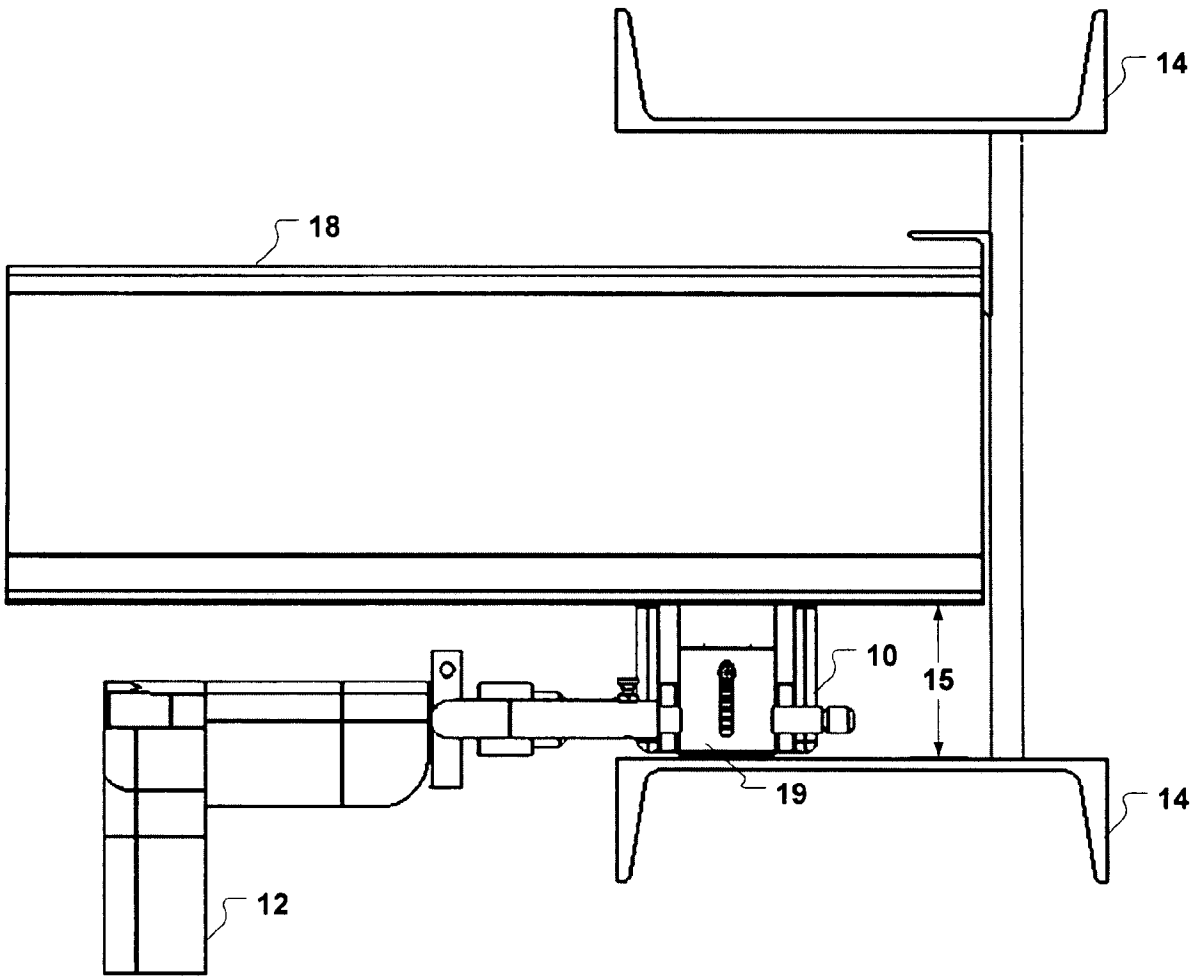
FIG. 2 illustrates a side view of an exemplary crimping device in accordance with certain embodiments

FIG. 2 illustrates a side view of the device 10, which includes a frame 19 that supports its internal and external components, inserted between the concrete foundation form 14 and the building panels 16, 18. As illustrated, the clearance 15 between the concrete foundation form 14 and the building panels 16, 18 is typically quite narrow, e.g., about 4" although it may vary depending on the particular application, e.g., may typically vary between 3" and 12". For example, the width of the concrete foundation form 14 (i.e., the distance between the sides) may be increased or decreased for different construction applications, which will correspondingly increase or decrease the clearance 15. Advantageously, embodiments of the present disclosure are compact enough to fit within this narrow clearance 15. In preferred embodiments the height of the frame (i.e., the distance between the top and the bottom of the device 10) is less than the clearance 15. For example, if the clearance is typically 4", the height of the device's frame would preferably be less than or equal to about 4". However, other heights may be desirable for different applications, e.g., about 3", 5", 6", 7", 8", 9", 10", 11", or 12". Thus the device 10 may readily fit into the confined space of the typical concrete form. Accordingly, the edge portions of the building panels 16, 18 can be crimped deep into the concrete foundation form 14 as desired using the rotary motion of the device 10 described below.

Figure 3:
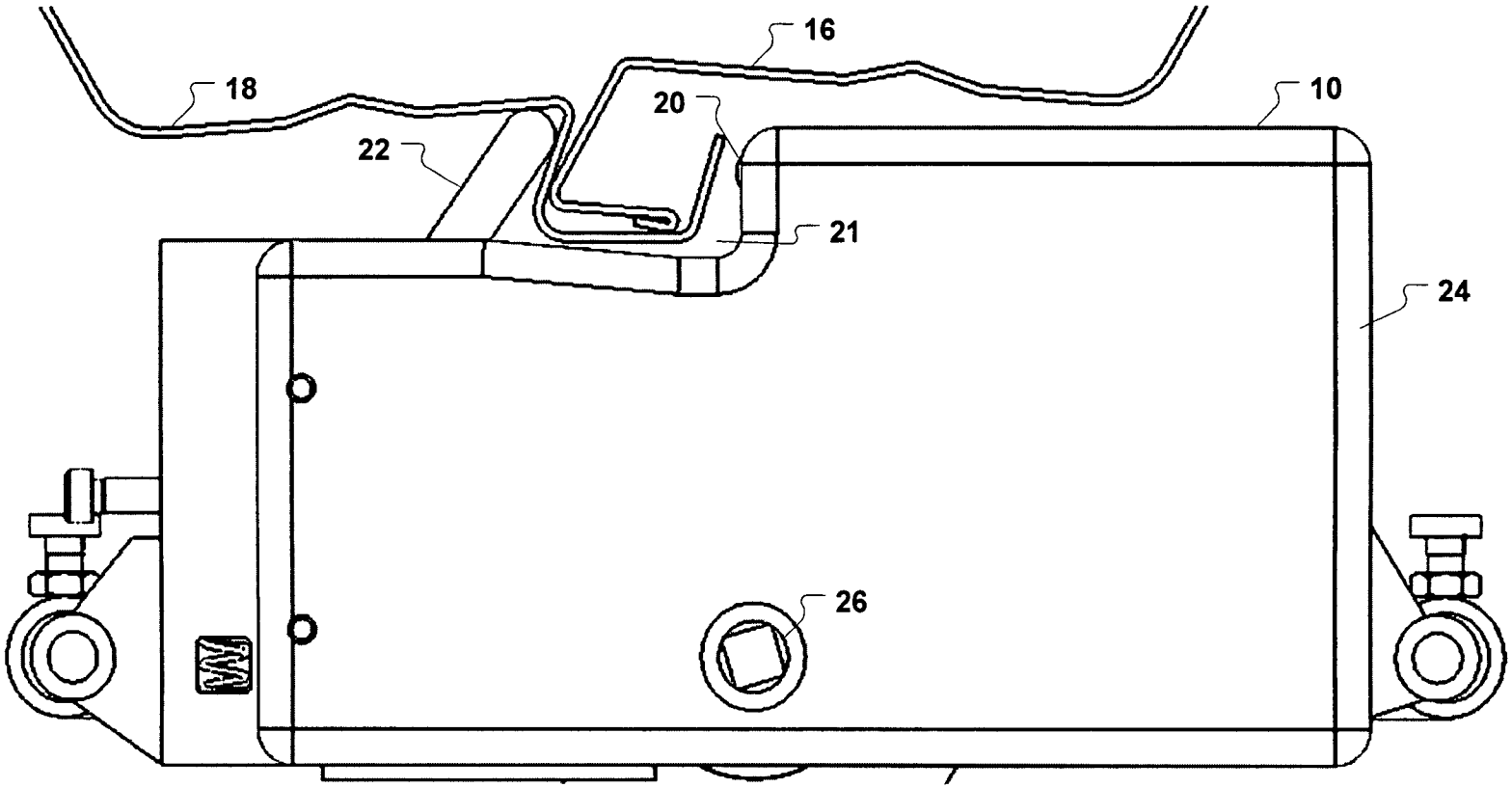
FIG. 3 illustrates a back view of an exemplary crimping device in accordance with certain embodiments.

FIG. 3 illustrates a back view of the device 10 inserted over the edge portions of building panels 16, 18. The exemplary crimping device 10 includes a crimping member 20 that is movable under the influence of the power source, and another crimping member 22 that is attached to the frame 19 and that is normally fixed in position during the crimping action. The crimping member 20 may be referred to herein as an "active" crimping member and the crimping member 22 may be referred to herein as a "fixed" crimping member for convenience. However, as will be described elsewhere herein, the crimping member 22 while normally fixed during crimping is also movable via a release mechanism to facilitate placement of the crimping device 10 at the seam of adjacent building panels. The crimping members 20 and 22 are separated by a region or gap 21, which is generally "U" shaped to accommodate the aligned adjacent edge portions of the panels 16 and 18. The shape of the gap is governed by the orientation and placement of fixed crimping member 22 as well as the shape of the frame 19 and side cover 24 in the region of the crimping members 20 and 22. The depth and width of the gap 21 can be selected depending upon the size of the building panels utilized, e.g., width of about 1" and depth of about 0.25". An upwardly extending edge portion of panel 18 is positioned adjacent to the active crimping member 20. A downwardly extending edge portion of the panel 18 is positioned adjacent to the fixed crimping member 22. The active crimping member 20 is configured to move within the device 10 while the fixed crimping member 22 is typically firmly attached to the frame 19 as described in more detail below. In certain embodiments, the device 10 has side covers 24 affixed to the exterior of the frame 19 that are constructed of a non-marring material so that the device will not scratch or damage the surface of building panels on which it is being applied. The non-marring material will typically be any suitable plastic material such as, for example, UHMW (ultra high molecular weight poly ethylene), ABS, Derlin, Teflon, nylon, polycarbonate, or even oil impregnated plastic such as Micropoly™. However, any other suitable material could be used as would be apparent to one of ordinary skill in the art. The side covers 24 can be affixed by way of hardware fastened into holes tapped in suitable portions of the frame 19. The side covers 24 are shaped so that, for the most part, only the crimping members 20, 22 interact with the panel during the crimping cycle. Advantageously, the side covers 24 also provide a non-marring slip plane for the device 10 during operation. In alternative embodiments, the side covers 24 may be integrated with the frame 19 as a fairing, and therefore not readily removable.

Figure 17A:
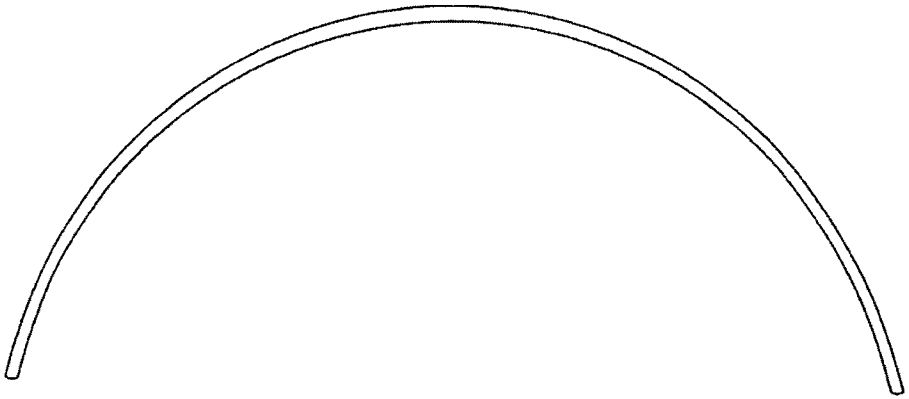
FIGS. 17*a* and 17*b* illustrate exemplary cross-sectional end views of an arch style and a gable style building respectively, each constructed of a plurality of building panels.
Figure 17B:
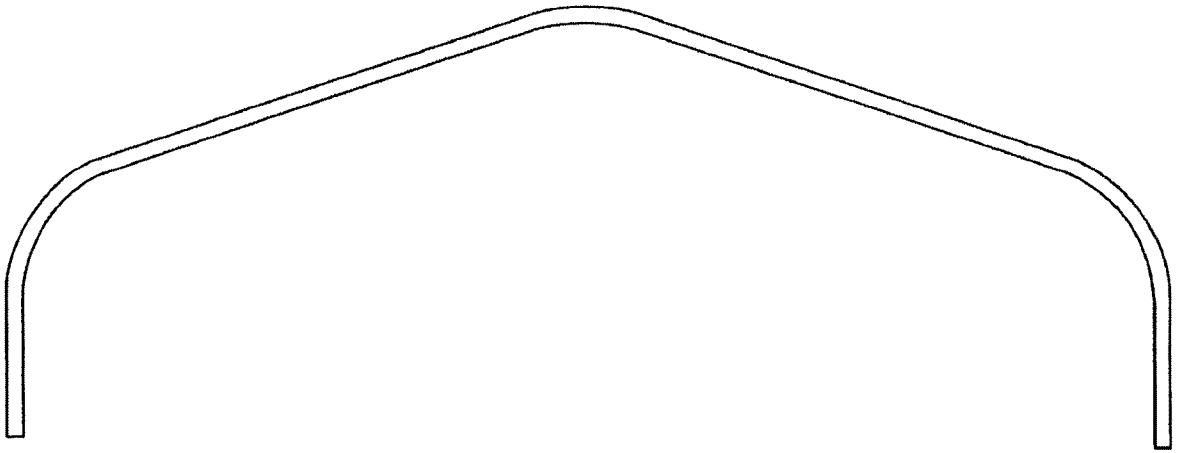

The crimping device 10 also has a rotatable shaft 26 that extends through both side covers 24 and is accessible from either side of the device exterior. The rotatable shaft 26 is configured to couple to a motor such as, for example, a power drill motor. Advantageously, because the rotatable shaft 26 is accessible from either side of the device 10, the motor can be attached to either side. Reversing the side of the device 10 that the motor is attached to may be desirable because the hook and seam of typical building panels is typically not symmetrical, i.e., the panels are typically only seamed on one side within a concrete foundation form 14. Thus the reversal of the attachment may be desirable for operating the device 10 on the other side of the building. For example, viewing the building illustrated in FIG. 17*a* from its end, the interconnected panels comprising the building each form an arch shape. Each end of this arch shape is typically placed in a foundation form. Because the hook and seam on the panels is located only on one face of the panels, e.g., the outside in FIG. 17*a*, the operator may have to reverse the motor attachment to fit within the foundation form on each side of the building. Accordingly, to crimp the panels on the left side of the building an operator would attach the power drill 12 to one side of the device 10, while to crimp the panels on the other side the operator would attach the power drill 12 to the other side of the device 10. Additionally, the building panels can be used to construct other types of buildings such as, for example, the gable style building illustrated in FIG. 17*b*.

Figure 4:
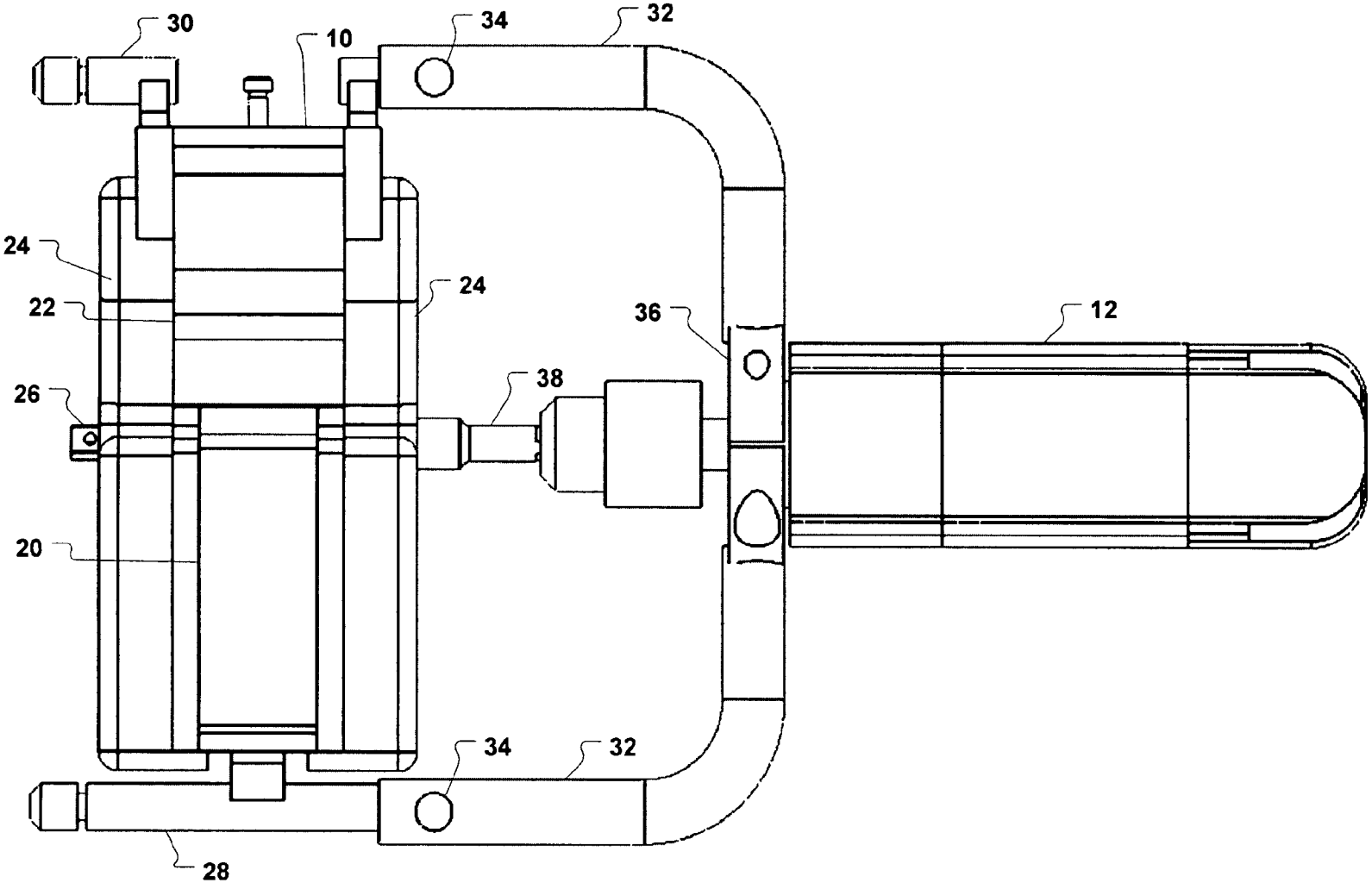
FIG. 4 illustrates a top view of an exemplary crimping device in accordance with certain embodiments.
Figure 5:
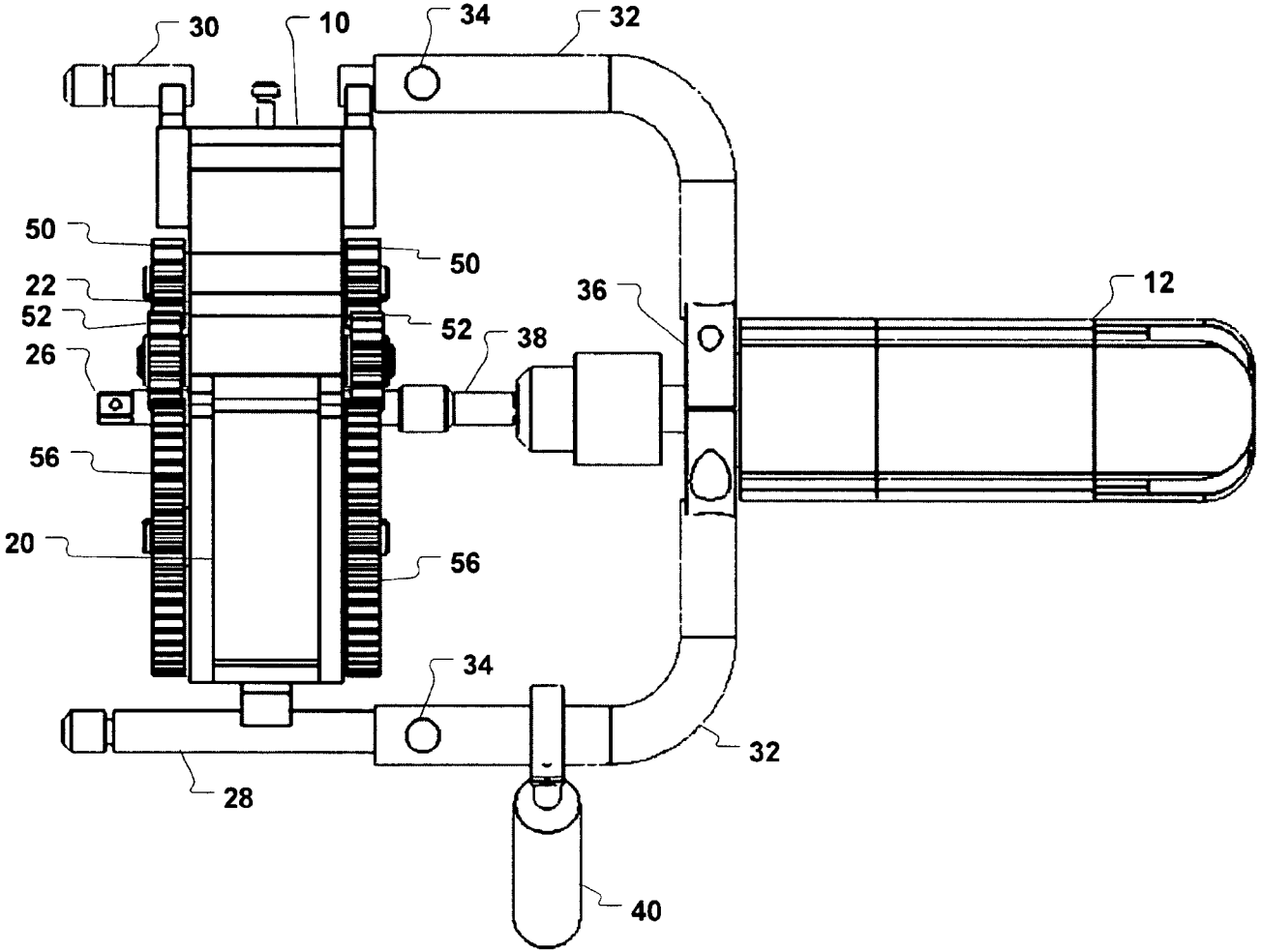
FIG. 5 illustrates a top view of an exemplary crimping device with side covers removed in accordance with certain embodiments.

FIG. 4 illustrates a top view of the exemplary crimping device 10 with a power drill 12 coupled to the shaft 26. As shown, the rotatable shaft 26 extends through the device 10 so that it is accessible from both exterior sides. In certain aspects, the device 10 has a beneficial safety feature that allows operators to keep their hands at a safe distance during the crimping cycle. Attachment shafts 28, 30 protrude from the body of the device on each side. These shafts 28, 30 allow a support member (e.g., tube or bar) 32 to slide over their protrusion. The attachment shafts 28, 30 contain a recessed channel that allows release pins 34 to engage and lock in that location. The support member 32 is then rigidly and permanently attached to a clamp collar 36. The clamp collar 36 clamps to drill motor 12 on an existing handle collar which is typical for this type of drill. The drill motor 12 is connected through a chuck to a shaft 38. This shaft 38 is used to drive shaft 26 to power the crimping device. In embodiments that utilize another type of motor, for example a motor specially designed for the device 10, one or more of the attachment shafts 28, 30, support member 32, clamp collar 36, or shaft 38 could be omitted. FIG. 5 illustrates a top view of the device 10 with the side covers 24 removed. In certain embodiments, a handle 40 can be attached to the support member 32 to make it easier for a user to support the device during operation.

Figure 6A:
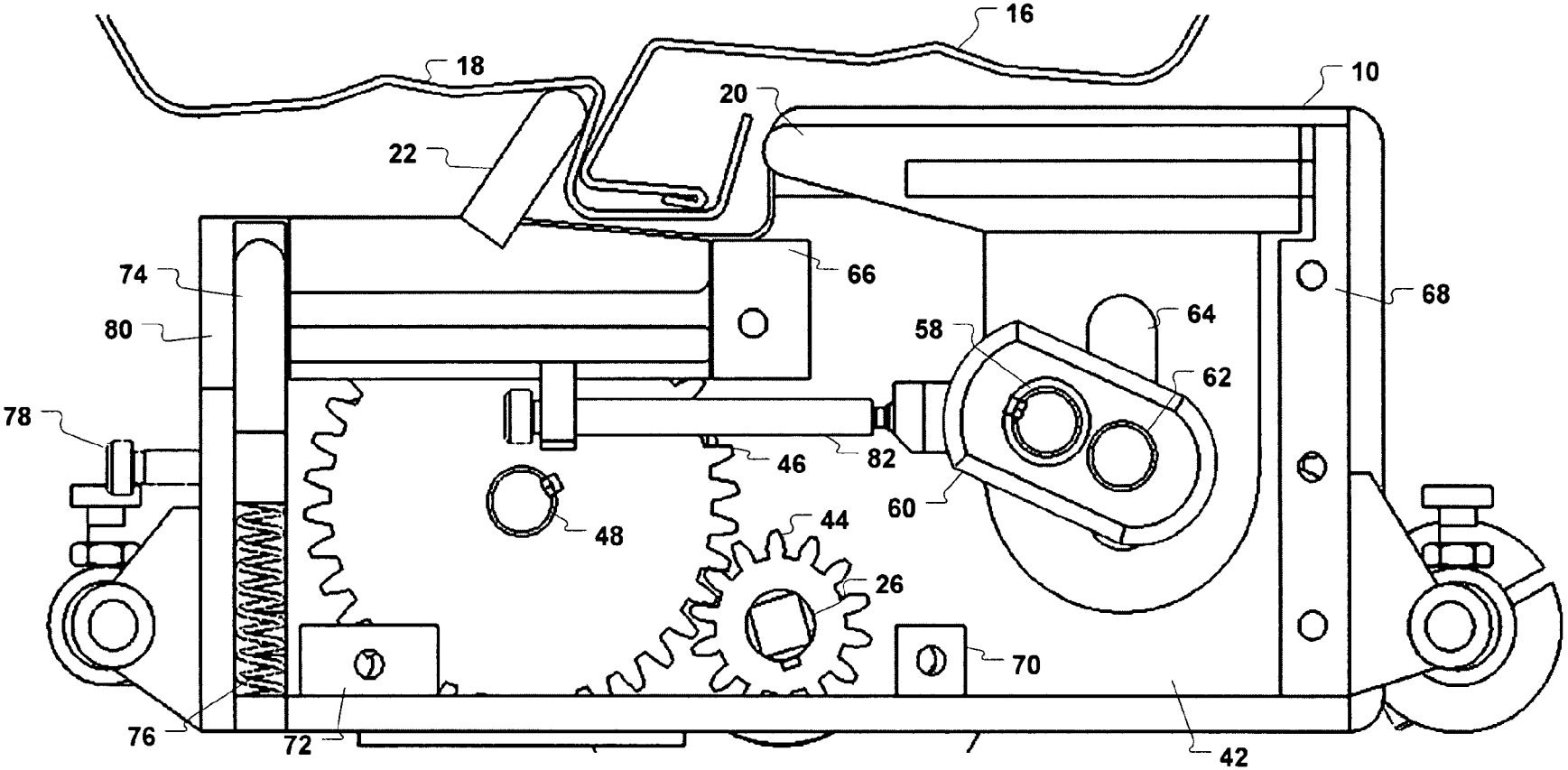
FIGS. 6*a* to 6*d* illustrate a cross-sectional view of an exemplary crimping device in accordance with certain embodiments.
Figure 6B:
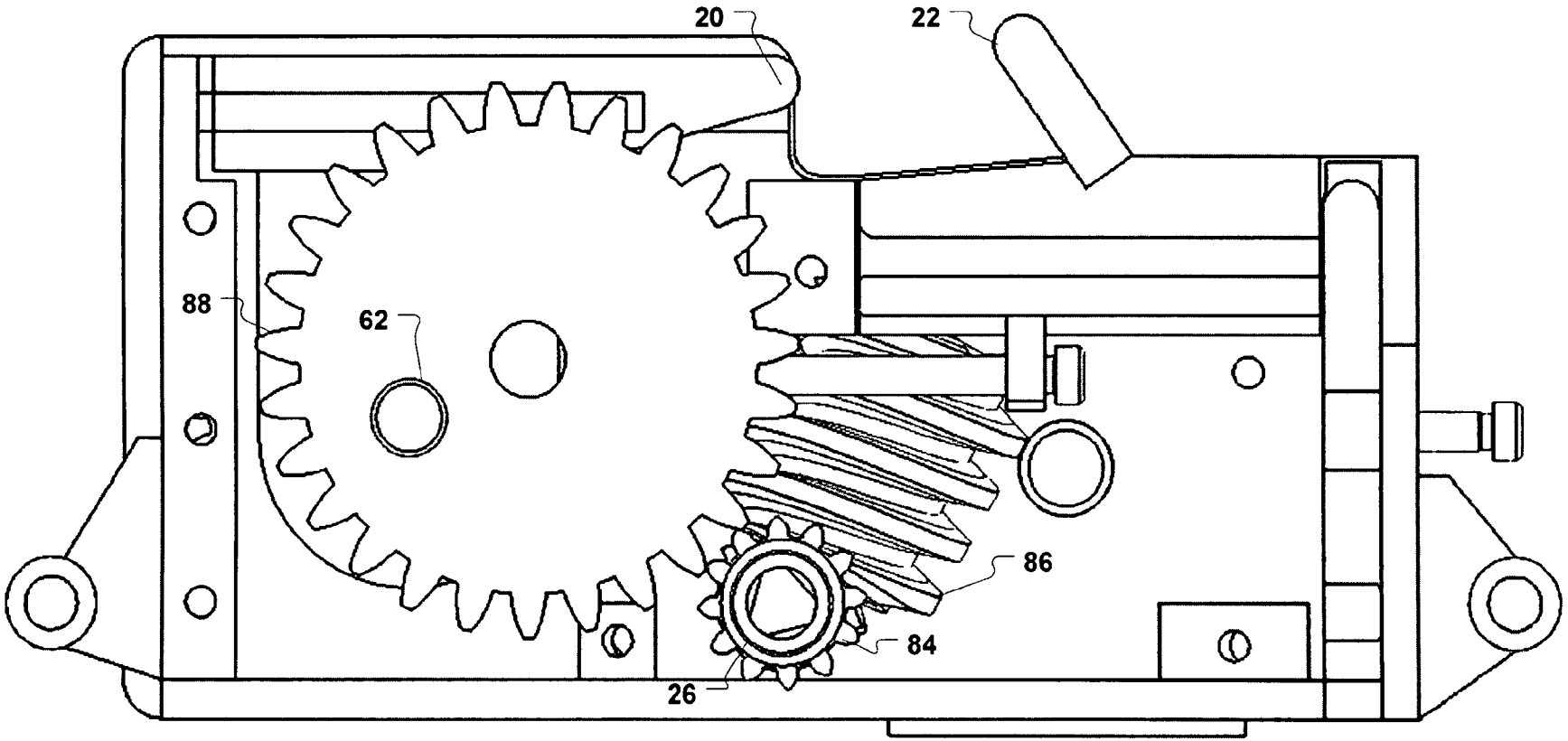
Figure 6C:
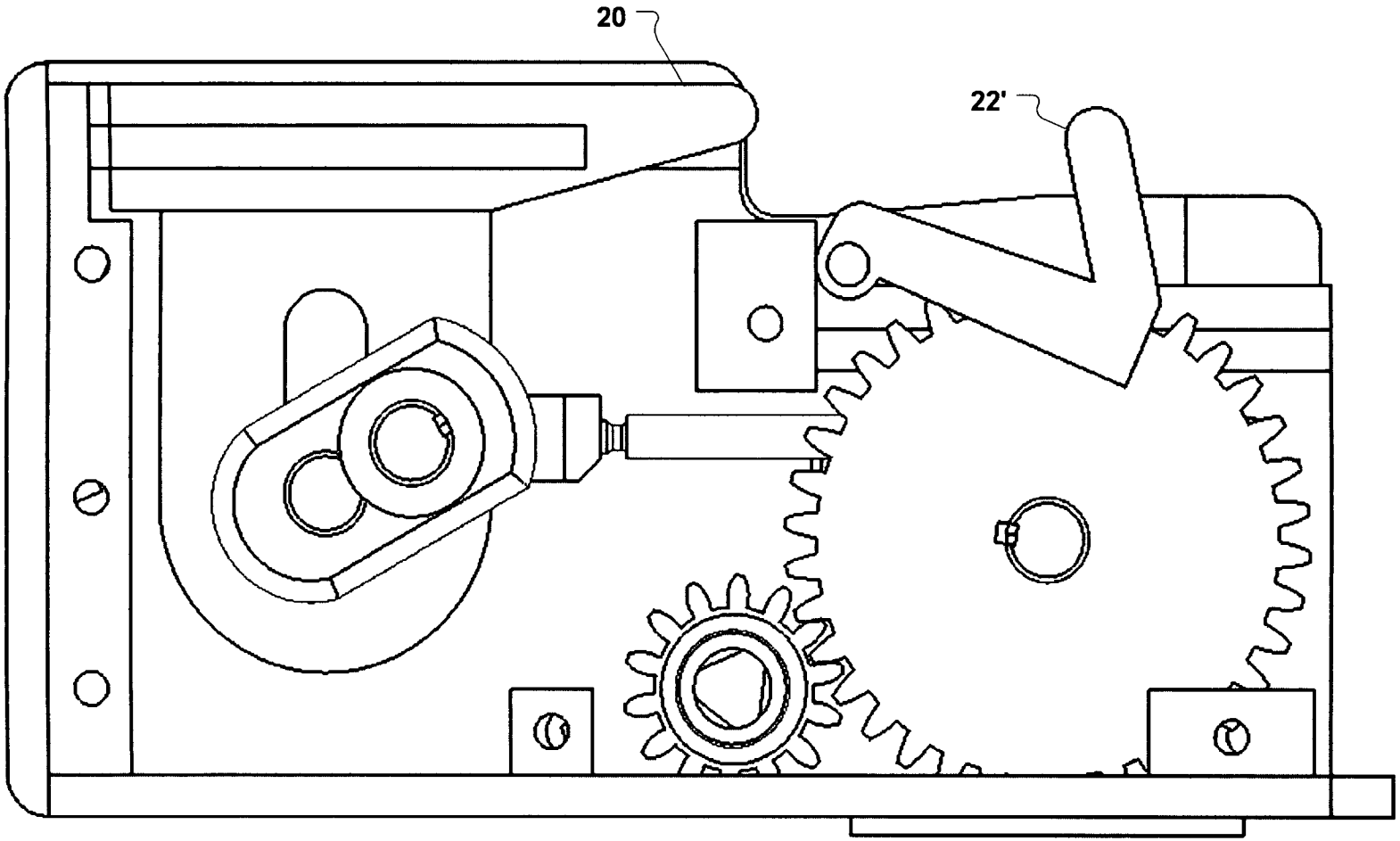
Figure 6D:
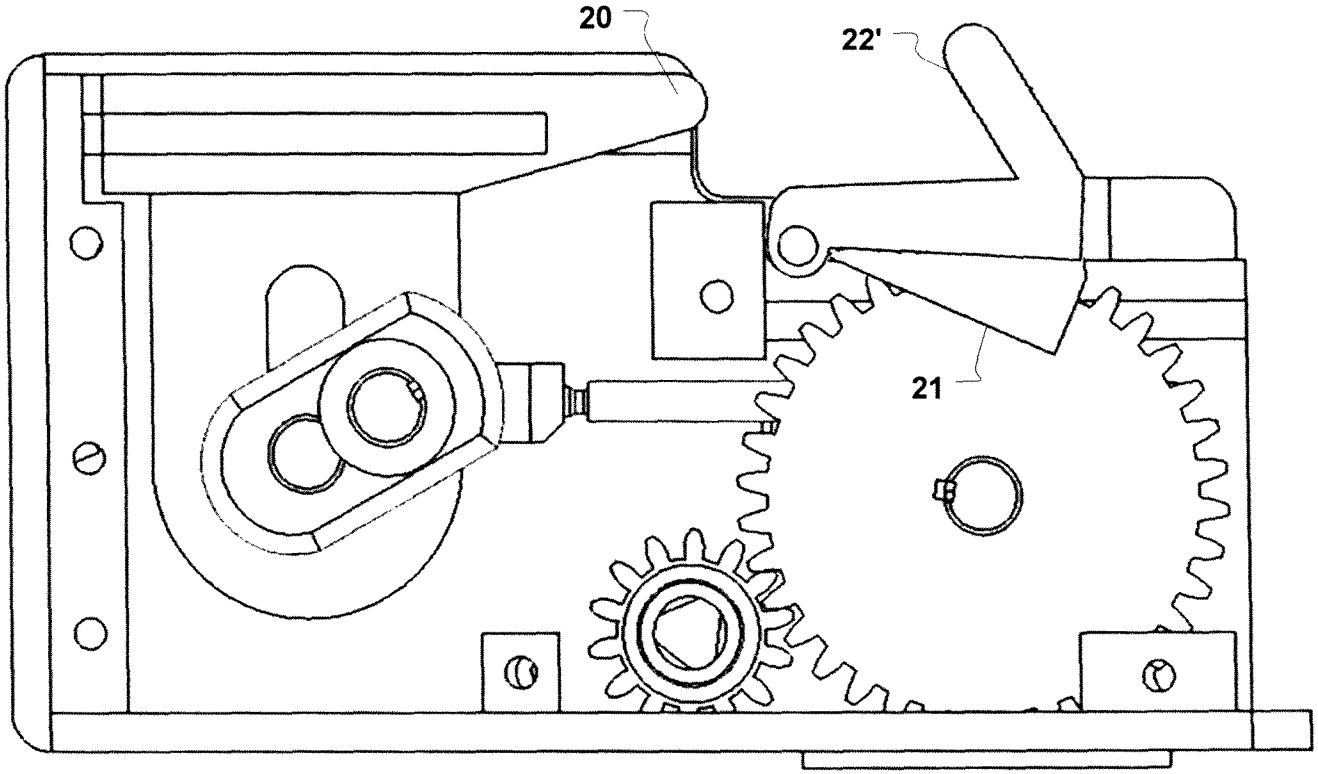

FIG. 6*a* illustrates a cross-sectional side views of the device 10. The rotatable shaft 26 passes through the frame 19 of the device 10, which includes two parallel internal side plates 42 that can be affixed to the frame 19 by way of brackets 66, 68, 70, and 72. The internal components shown in FIG. 6*a* are located between these internal side plates 42. Fixed to rotatable shaft 26 is a gear 44 that transmits motion to gear 46. The gear 46 is attached to a shaft 48 that is supported by and passes through both internal side plates 42. The gears illustrated in this exemplary embodiment are spur gears, however, other suitable types of gears could be used as would be readily apparent to one of ordinary skill in the art.

Figure 7:
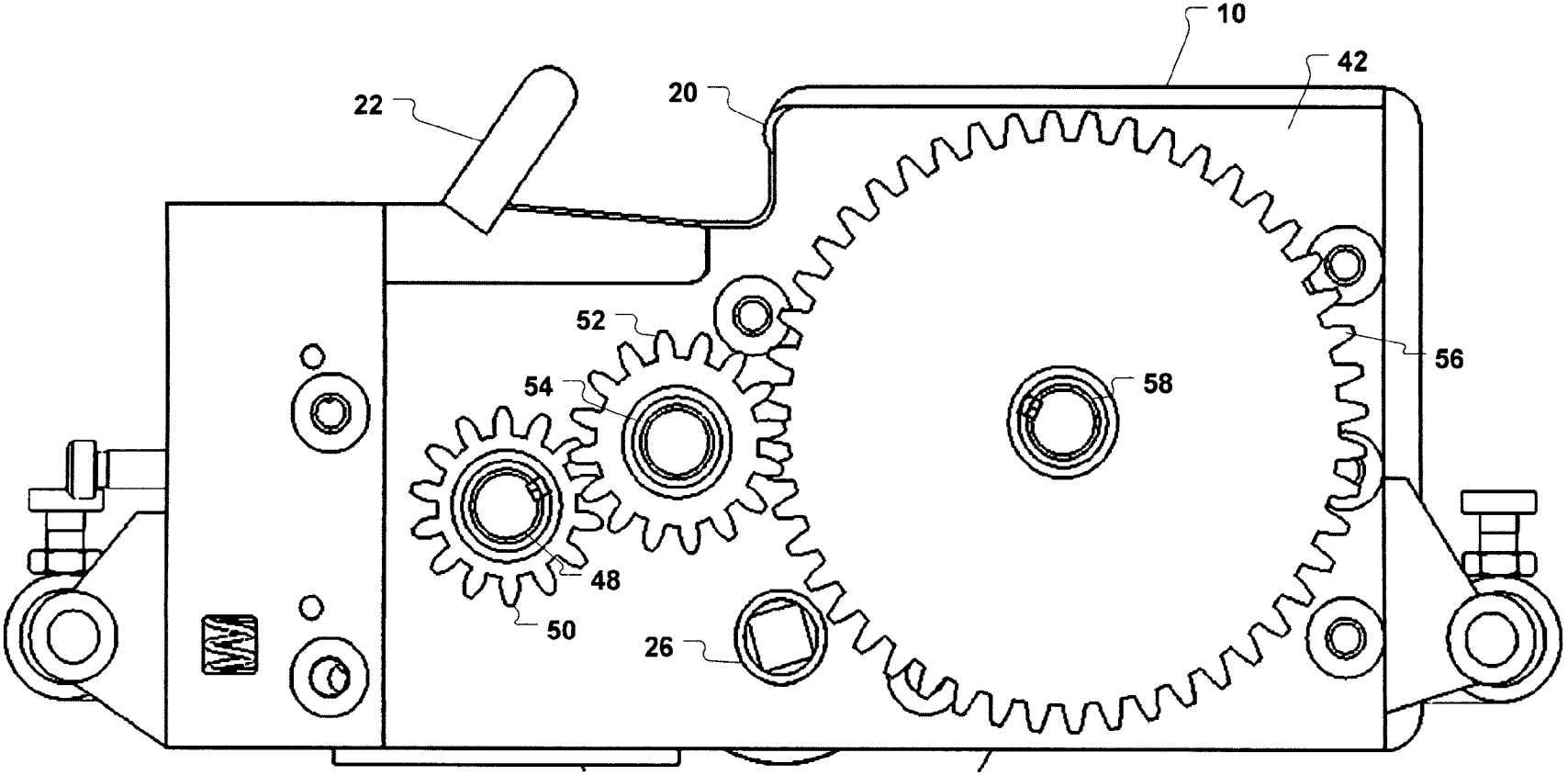
FIG. 7 illustrates another cross-sectional view of an exemplary crimping device in accordance with certain embodiments.

FIG. 7 illustrates a side view of the device 10 with the side covers 24 removed. The shaft 48 is also attached to a gear 50 on the exterior of the internal side plates 42. This configuration allows the gear 46 to transmit motion to the gear 50. The gear 50 is coupled to transmit motion to the gear 52. The gear 52 rotates freely about the shaft 54, which is rigidly fixed to an internal side plate 42. The gear 52 transmits motion to the gear 56, which is rigidly attached to a shaft 58. The configuration of gears and shafts of the device 10 is referred to collectively herein as a gear train and serves to reduce the rotational speed of the shaft 48 while simultaneously increasing the torque. It should be noted that the gears 50, 56 are located on both ends of their respective shafts 48, 58, and the gear 52 is duplicated on both sides of the device as illustrated in FIG. 5. The present inventors have found that this configuration of redundant gears may be advantageous because it evenly distributes the torque of the gear train, thereby facilitating higher torque values, while also minimizing the footprint of the gear train.

While the gear train has been described with respect to a specific exemplary embodiment, many variations are possible that still fall within the scope of the present disclosure. For example, the gear train could include a set of worm gears. In the exemplary embodiment shown in FIG. 6*b*, the worm 86 is coupled to worm gear 88. Many other gear configurations could also be used as would be apparent to one of ordinary skill in the art.

Referring back to the exemplary embodiment of FIG. 6*a*, the shaft 58 is supported by and freely rotates within the internal side plates 42. The shaft 58 is rigidly fixed to a crank 60, which is between the internal side plates 42. The crank 60 transmits motion to a crank wrist pin 62. The crank wrist pin 62 travels through a slot 64 in the active crimping member 20 and thereby imparts rectilinear motion. The configuration of the shaft 58, crank 60, and crank wrist pin 62 is referred to collectively herein as a drive mechanism.

While the drive mechanism has been described with respect to a specific embodiment, many variations are possible that still fall within the scope of the present disclosure. For example, the wrist pin 62 could be connected to a gear that is coupled to the gear train. In the exemplary embodiment shown in FIG. 6*b*, gear 84 drives worm 86 which is coupled to worm gear 88, which has the wrist pin 62 coupled therethrough. The wrist pin 62 is attached through a slot in the active crimping member 20, thereby driving the active crimping member 20 toward and then away from the fixed crimping member 22 in a repeating, reciprocating motion under the influence of the drive mechanism while the rotation of the shaft 26 is maintained. Any other configuration capable of converting the rotational motion of the shaft to rectilinear motion could be used as would be readily apparent to one of ordinary skill in the art.

The active crimping member 20, which is adapted to engage an upwardly extending edge portion of the building panel 18, is guided along a rectilinear path by channels in internal side plates 42. The active crimping member 20 is driven toward the fixed crimping member 22 by this rectilinear motion to bend the upwardly extending edge portion of the building panel 18 over the edge portion of the other building panel 16. The drive mechanism repeatedly drives the active crimping member 20 toward and then away from the fixed crimping member 22 in a reciprocating motion as the drill motor 12 rotates the exterior shaft 26.

Advantageously, the novel configuration of the gear train and the drive mechanism in the device 10 allow certain embodiments of the present disclosure to be made much more compact than prior devices.

In certain embodiments, the device 10 includes a useful feature that allows the fixed crimping member 22 to be moved to facilitate ease of engagement upon the edge portions of adjacent building panels. FIG. 6*a* illustrates an exemplary embodiment of this feature. A release gate 74 is biased (i.e., held in tension by spring force) by a spring 76 to remain in a closed position until an operator applies a load to the release handle 78 in a direction perpendicular to and away from the fixed crimping member. The release gate 74 is adapted to slide within the channel provided by release frames 80. Once the release gate 76 has moved downward enough to allow sufficient clearance, fixed crimping member 22 will slide within support channels created by the side plates 42. The fixed crimping member's 22 direction of motion is parallel to and opposite that of active crimping member 20. Fixed crimping member 22 is also attached to a shaft 82. This shaft 82 is attached on one side to the fixed crimping member 22. The shaft 82 limits the travel of the fixed crimping member 22 when the release gate 74 is lowered. The shaft 82 is attached on the other side to an ear formed in active crimping member 20, which provides the rectilinear motion previously mentioned. When the drive mechanism is cycled, the shaft 82 will act upon the active crimping member 22 to draw it back into is original operational position, thereby allowing the release gate 74 to return to its original operational position via the response of the spring 76. At this point the crimping members 20, 22 are prepared to crimp the edge portions of the building panels.

While described with respect to an exemplary embodiment, this feature could be implemented in a variety of different ways. For example, in an exemplary embodiment shown in FIGS. 6*c* and 6*d*, the fixed crimping member 22 ' could be attached by a hinge to the frame and a removable wedge 21 could be engaged in a slot beneath the fixed crimping member 22 ' to maintain it in place. To release the fixed crimping member 22 ' to facilitate ease of engagement on a seam, the wedge 21 could be removed and the fixed crimping member 22 ' pivoted downward into the frame 19 of the device 10. In certain embodiments this feature may be omitted altogether. For example, in certain embodiments the fixed crimping member 22 may be permanently attached to the frame.

In typical applications, approximately 2000 lbf. at the jaws of the crimping members will be sufficient to crimp conventional building panels, e.g., 0.060" to 0.025" steel panels. The inventors have empirically found that a reduction gear ratio of 8.8:1 will produce approximately 2000 lbf at the jaws of the crimping members from the torque produced by a typical 620 W power drill motor. Naturally, if thicker gauges of building panels are used, higher amounts of force will be desirable at the jaws. In these instances, the gear ratio could be adjusted by modifying the gear train to provide sufficient force as would be readily apparent to one of ordinary skill in the art.

Figure 8A:
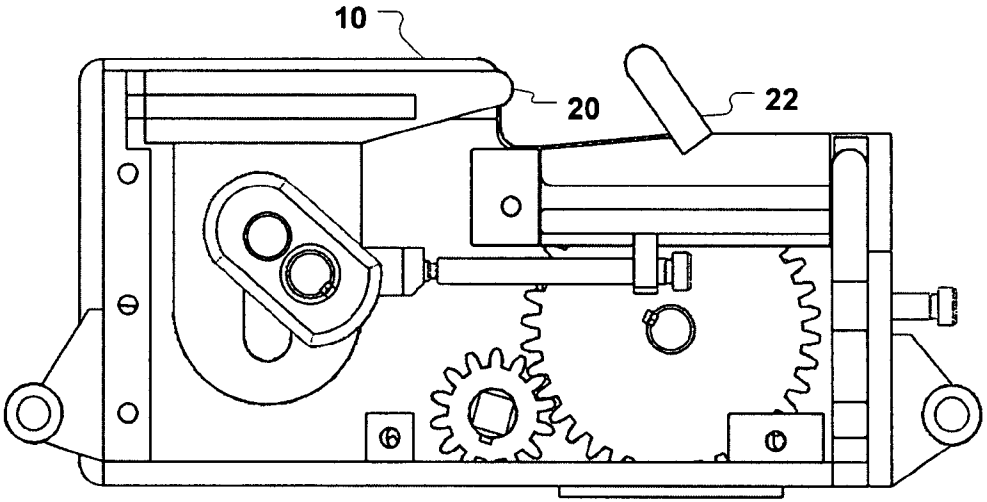
FIGS. 8*a* to 8*d* illustrate the operation of an exemplary crimping device in accordance with certain embodiments.
Figure 8B:
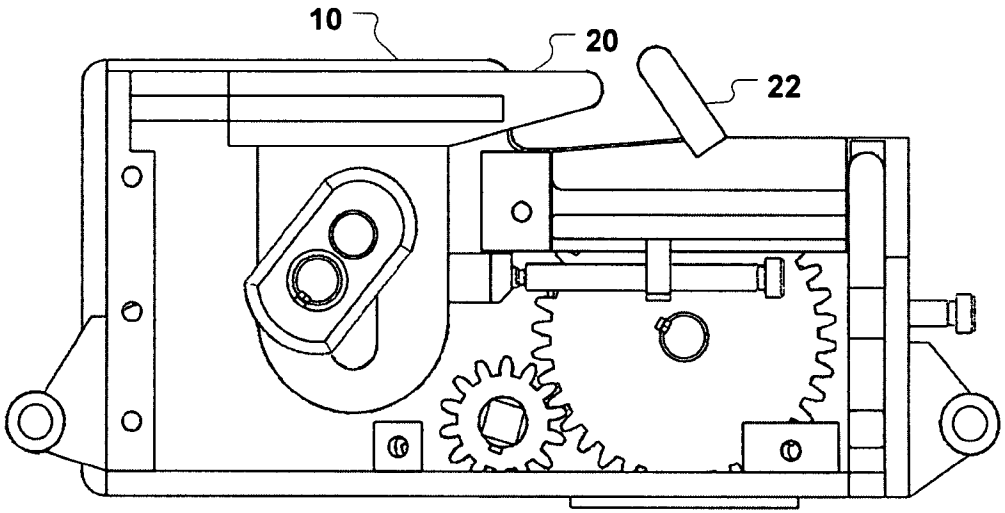
Figure 8C:
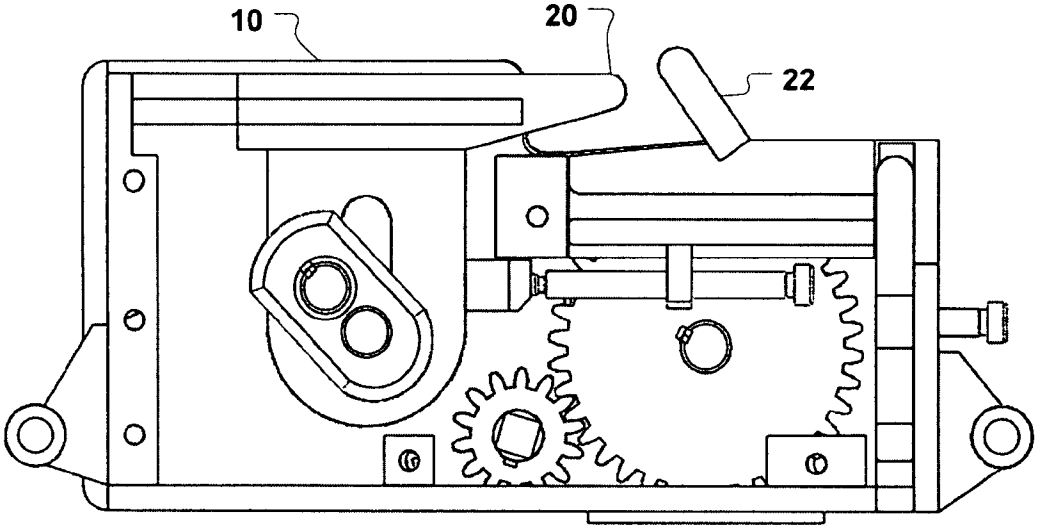
Figure 8D:
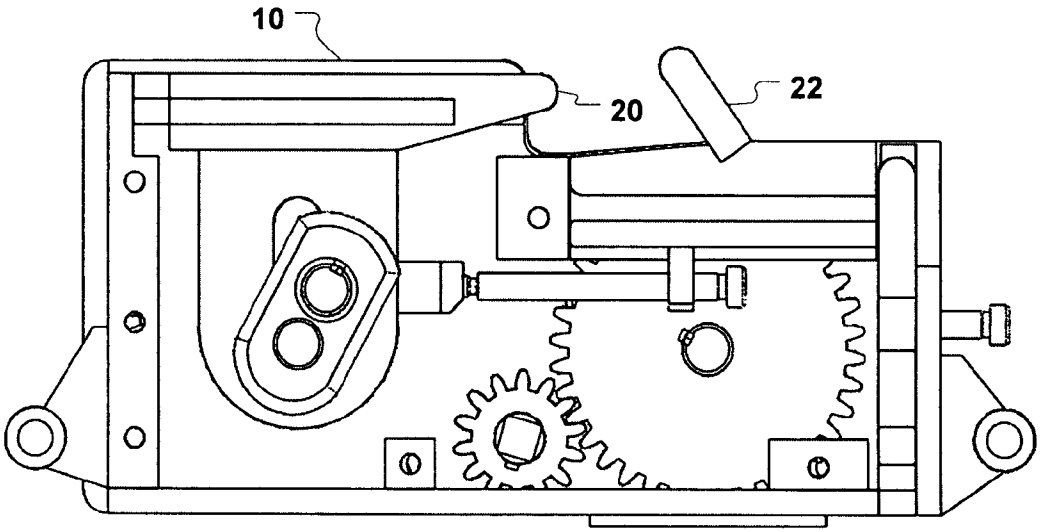

The crimping operation of the device 10 will now be described with reference to exemplary embodiments shown in FIGS. 8*a* to 8*d*. In operation, the active crimping member 20 moves toward and then away from the fixed crimping member 22 in a repeating, reciprocating motion under the influence of the drive mechanism while the rotation of the shaft 26 is maintained, such that the active crimping member 20 is configured to bend an edge portion of a first building panel over an edge portion of a second building panel. FIG. 8*a* shows the drive mechanism in a first position that has moved the active crimping member 20 to a fully retracted position (i.e., fully housed within the device 10). FIG. 8*b* shows the drive mechanism in a second position that has partially extended the active crimping member 20 toward the fixed crimping member 22. FIG. 8*c* shows the drive mechanism in a third position that has moved the active crimping member 20 to a fully extended position (i.e., moved fully toward the fixed crimping member 22). At this position, if the device 10 were engaged to the edge portions of building panels, the edge portions would be crimped. FIG. 8*d* shows the drive mechanism in a fourth position that has partially retracted the active crimping member 20 away from the fixed crimping member 22.

FIGS. 9-16 illustrate examples of the type of building panels to which embodiments of the present disclosure can be applied, though its application to other types of panels not specifically set forth will be readily recognized.

Figure 9:
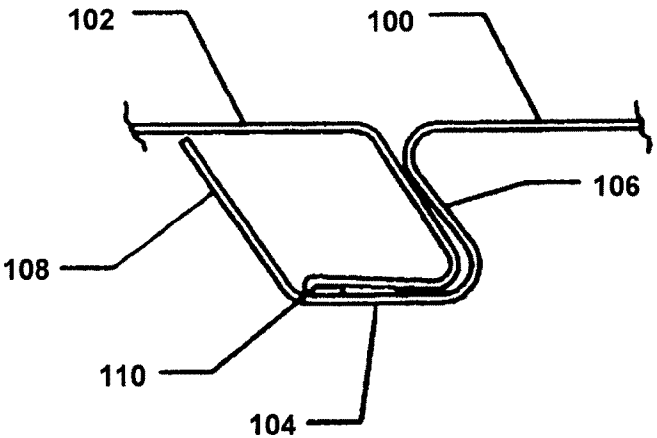
FIGS. 9 and 10 illustrate cross sectional views of one type of building panels suitable for application of embodiments of the present disclosure, with the upturned terminal portion unbent and bent, respectively.
Figure 10:
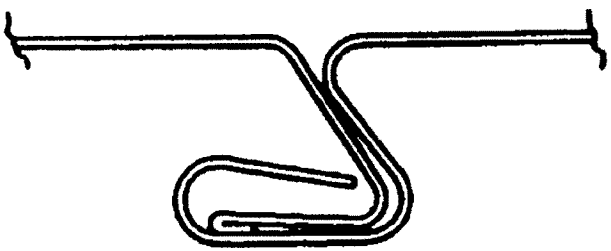

The panels shown in FIGS. 9-16 are commonly used to form arched roof sections of building structures as is known in the art and shown by U.S. Pat. No. 3,902,233 (1975) and U.S. Pat. No. 4,364,253 (1982). FIGS. 9 and 10 show a first panel 100 with an outturned side edge portion having an downwardly extending outwardly turned flange portion and a upwardly extending terminal portion 108, forming a U-shaped channel. In other words, a first section 106 extends downwardly from the panel, a second section 104 extends outward laterally from the first section 106, and a third section 108 extends upwardly from the second section 104 to form the U-shaped channel. The second panel 102 includes an inturned side edge with a hem portion 110 disposed inside the U-shaped channel of the first panel. This inturned side edge portion has a first section extending downwardly from the panel and a second section extending laterally from the first section; these sections respectively fit into the first and second sections of the first panel, as shown in FIG. 9.

In operation, the fixed crimping member 22 is disposed on the downwardly extending portion 106 of panel 100 while the active crimping member 22 is adjacent to the upwardly extending portion 108. As the active crimping member 22 is driven toward the fixed crimping member 20, the upwardly extending portion 108 is bent over the hem portion of the second panel 102 as shown in FIG. 10.

Figure 11:
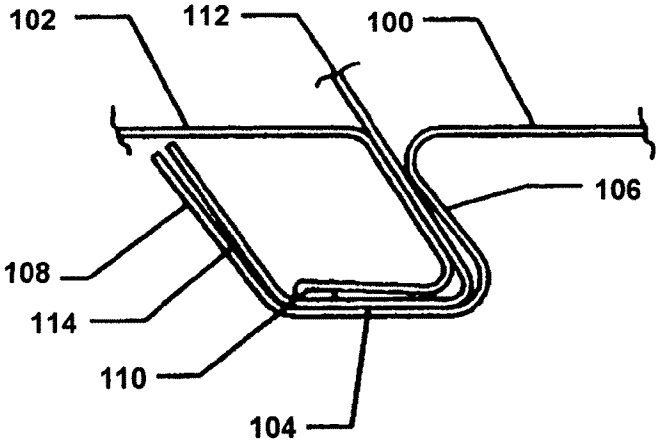
FIGS. 11 and 12 illustrate cross sectional views of the type of panels in FIGS. 9 and 10 but with a tab portion of an additional member disposed therebetween.
Figure 12:
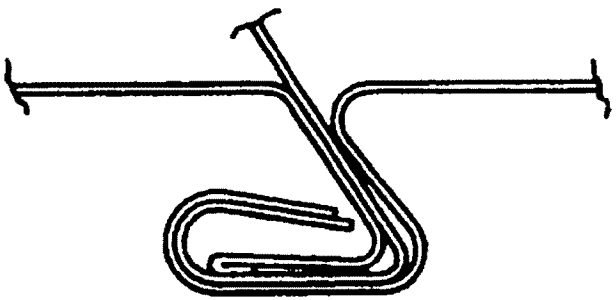

FIGS. 11 and 12 show building panels similar to those depicted in FIGS. 9 and 10 but having the tab or edge portion 114 of an additional panel 112 disposed therebetween. This edge portion 114, which extends from, for example, roofing panels, lighting fixtures, ventilation ducts, ceiling panels, or the like, is typically also crimped to allow application of a rotary seaming device. The active crimping member 20 easily bends this portion 114 along with the upwardly extending terminal portion 108 of panel 100 over the edge of panel 102, as shown in FIG. 9.

Figure 15:
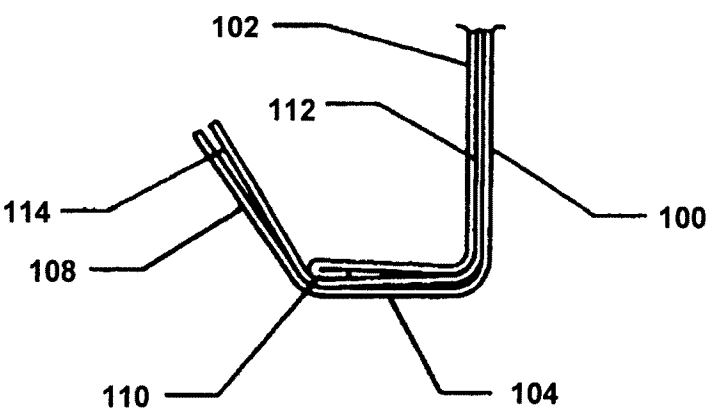
FIGS. 15 and 16 illustrate cross sectional views of the type of panels in FIGS. 13 and 14 but with a tab portion of an additional member disposed therebetween.
Figure 16:
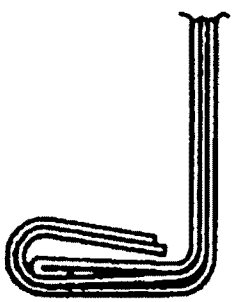
Figure 13:
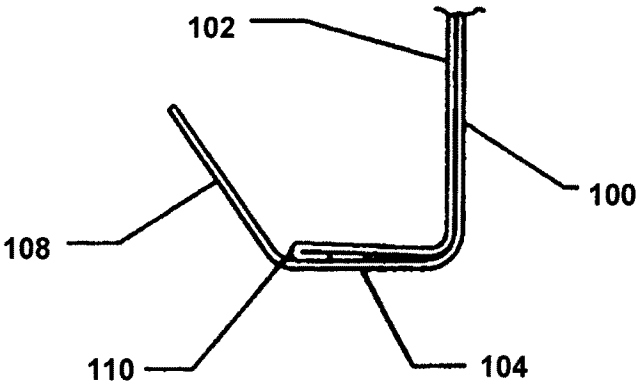
FIGS. 13 and 14 illustrate cross sectional views similar to FIGS. 9 and 10 but of another type of panels suitable for application of embodiments of the present disclosure.
Figure 14:
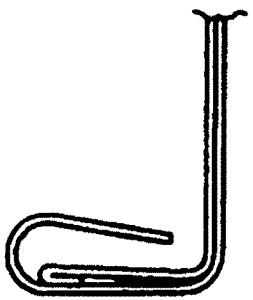

FIGS. 13-16 show panels commonly used for straight roof sections but which can also be used for those of the arched type. The operation of the crimping device on this type of panel is essentially the same as on the panels of FIGS. 9-12. The active crimping member 20 engages upwardly extending edge portion 108 of panel 100 and bends it over the edge portion 110 of the other panel 102. This allows application of rotary seaming device to finish the connection by forming a continuous watertight seam. FIGS. 15 and 16 show the panels of FIGS. 13 and 14 with the tab or edge portion 114 of an additional member 112 disposed therebetween, similar to FIGS. 11 and 12.

Although the building panels have been described with a certain degree of particularity, it should be understood that this disclosure has been made by way of example and that changes in details of structures may be made without departing from the spirit thereof. For example, on one side, the building panels can be formed to include an outturned side edge portion having a upwardly extending outwardly turned flange portion and a downwardly extending terminal portion, thereby creating an inverted U-shaped channel. In other words, a first section extends upwardly from the panel, a second section extends outward laterally from the first section, and a third section extends downwardly from the second section to form the inverted U-shaped channel. This configuration is typically referred to as a hook. On the other side, the panels can be formed to include an inturned side edge portion having an inwardly turned flange portion that can be disposed inside the inverted U-shaped channel of the first side.

The previously described embodiments of the present disclosure may have one or more advantages including:

An advantage of certain embodiments is to reduce operator fatigue and make the crimping process easier by using reciprocating motion to constantly move the crimping blades in a repeatable open and close motion as long as power is maintained on the motor.

Another advantage of certain embodiments is to allow a crimping device to easily fit into a confined space. Due to the novel configuration of the gear train and the drive mechanism in the device, embodiments of the present disclosure can be made much more compact than prior devices. Also, the reciprocating motion in combination with the compact size allows a user to easily crimp a panel seam deep into the concrete form thus providing a watertight seal of the panels deep into a concrete form.

Yet another advantage of certain embodiments is to provide a crimping device that will not scratch or damage the surface of the building panels on which it is being applied.

Another advantage of certain embodiments is to allow a crimping device to be driven by a commercially available off-the-shelf motor such as a power drill.

Still a further advantage of certain embodiments is that the motor can be coupled to either of two sides of the device, thereby allowing the device to be operated on building panels that do not have symmetrical seams.

Although embodiments of the present disclosure have been described in considerable detail with reference to certain versions thereof, other versions are possible. Therefore, the spirit and scope of the appended claims should not be limited to the description of the versions contained herein.

The reader's attention is directed to all papers and documents which are filed concurrently with this specification and which are open to public inspection with this specification, and the contents of all such papers and documents are incorporated herein by reference.

The present invention has been described by way of exemplary embodiments to which it is not limited. It will be appreciated by those skilled in the art that various modifications can be made without departing from the scope of the invention as set forth in the claims.

The invention claimed is:

1. A device for crimping together adjacent edge portions of two building panels, the device comprising:

a. a frame supporting a rotatable shaft protruding therethrough;

b. a first crimping member attached to the frame;

c. a gear train supported by the frame coupled to the rotatable shaft such that a rotation of the rotatable shaft imparts rotary motion to the gear train;

d. a drive mechanism supported by the frame and rotatably coupled to the gear train; and e. a second crimping member supported by the frame and coupled to the drive mechanism, f. wherein the second crimping member is configured to move toward and then away from the first crimping member via rectilinear motion in a repeating, reciprocating manner under influence of the drive mechanism while rotation of the rotatable shaft is maintained, such that the second crimping member is configured to bend an edge portion of a first building panel over an edge portion of a second building panel, g. wherein the rotatable shaft is adapted to be coupled to a power drill such that the device can be hand-held and driven by the power drill when operated.

2. The device of claim 1 wherein a height of the frame is about 4 inches.

3. The device of claim 1 wherein an exterior surface of the device includes a non-marring material.

4. The device of claim 1 further comprising a motor coupled to the rotatable shaft.

5. The device of claim 1 wherein the first crimping member is configured to be moved from a first position to a second position to facilitate ease of engagement upon the edge portions of the first and second building panels.

6. The device of claim 1 further comprising:

a. a release gate supported by the frame and biased in a direction such that the release gate maintains the first crimping member in a first position; and b. a release handle attached to the release gate, the release handle being operable by a user;

c. wherein the first crimping member is biased toward the release gate such that when the release handle is operated, the first crimping member is driven away from the second crimping member into a second position; and d. wherein the first crimping member is coupled to the drive mechanism such that motion of the drive mechanism returns the first crimping member to the first position.

7. The device of claim 1 further comprising a removable wedge coupled to the frame and engaging the first crimping member, wherein the first crimping member is pivotably attached to the frame such that removal of the removable wedge allows the first crimping member to pivot into the frame so that the first crimping member can be moved to facilitate engagement of edge portions of the first and second building panels.

8. The device of claim 1 wherein the gear train comprises a set of spur gears.

9. The device of claim 1 wherein the gear train comprises a set of worm gears.

10. The device of claim 1 wherein the second crimping member includes a slotted portion formed therein, and wherein the drive mechanism comprises a crank coupled to a crank wrist pin, said crank wrist pin coupled to the slotted portion of the second crimping member.

11. The device of claim 1, wherein the gear train comprises a first set of gears and a second set of gears, the second set of gears being redundant to the first set of gears.

12. An device for crimping together adjacent edge portions of two building panels, the device comprising:

a. a frame supporting a rotatable shaft protruding therethrough;

b. a first crimping member attached to the frame;

c. a reduction means coupled to the rotatable shaft and supported by the frame, for reducing a rotational speed of another shaft while simultaneously increasing torque;

d. a transforming means supported by the frame and rotatably coupled to the gear train, for converting the rotational motion of the rotatable shaft into a rectilinear motion; and e. a second crimping member supported by the frame and coupled to the reduction means, f. wherein the second crimping member is configured to move toward and then away from the first crimping member in a repeating, reciprocating motion under influence of the transforming means while rotation of the rotatable shaft is maintained, such that the second crimping member is configured to bend an edge portion of a first building panel over an edge portion of a second building panel, g. wherein the rotatable shaft is adapted to be coupled to a power drill such that the device can be hand-held and driven by the power drill when operated.

13. The device of claim 12 wherein a height of the frame is about 4 inches.

14. The device of claim 12 wherein an exterior surface of the device includes a non-marring material.

15. The device of claim 12 further comprising a motor coupled to the rotatable shaft.

16. The device of claim 12 wherein the first crimping member is configured to be moved from a first position to a second position to facilitate ease of engagement upon the edge portions of the first and second building panels.

17. The device of claim 12 further comprising:

a. a release gate supported by the frame and biased in a direction such that the release gate maintains the first crimping member in a first position; and b. a release handle attached to the release gate, the release handle being operable by a user;

c. wherein the first crimping member is biased toward the release gate such that when the release handle is operated, the first crimping member is driven away from the second crimping member into a second position; and d. wherein the first crimping member is coupled to the transforming means such that motion of the transforming means returns the first crimping member to the first position.

18. The device of claim 12 further comprising a removable wedge coupled to the frame and engaging the first crimping member, wherein the first crimping member is pivotably attached to the frame such that removal of the removable wedge allows the first crimping member to pivot into the frame so that the first crimping member can be moved to facilitate engagement of edge portions of the first and second building panels.

19. A method of crimping together adjacent edge portions of two building panels, the method comprising the steps of:

a. coupling a crimping device having a frame, a first crimping member and an opposing second crimping member to a power drill such that the crimping device can be hand-held and driven by the power drill when operated;

b. engaging the crimping device onto a seam of two adjacent building panels;

c. activating the crimping device such that the second crimping member repeatedly moves toward and then away from the first crimping member via rectilinear motion in a reciprocating manner, so as to engage the seam of the two building panels under influence of a drive mechanism, thereby crimping together edge portions at the seam of the two building panels; and d. moving the crimping device lengthwise along the seam of the building panels such that a substantial lengthwise portion of the seam is crimped together.

20. The method of claim 19 wherein the frame has a height of about 4".

* * * * *